US008770305B2

(12) United States Patent
Barrash et al.

(10) Patent No.: US 8,770,305 B2
(45) Date of Patent: Jul. 8, 2014

(54) MODULAR HYDRAULIC PACKER-AND-PORT SYSTEM

(75) Inventors: Warren Barrash, Boise, ID (US); Michael Cardiff, Boise, ID (US)

(73) Assignee: Boise State University, Boise, ID (US)

( * ) Notice: Subject to any disclaimer, the term of this patent is extended or adjusted under 35 U.S.C. 154(b) by 223 days.

(21) Appl. No.: 13/232,876

(22) Filed: Sep. 14, 2011

(65) Prior Publication Data

US 2012/0125641 A1 May 24, 2012

Related U.S. Application Data

(60) Provisional application No. 61/416,200, filed on Nov. 22, 2010.

(51) Int. Cl.
*E21B 33/12* (2006.01)

(52) U.S. Cl.
USPC ..... 166/387; 166/187

(58) Field of Classification Search
USPC ..... 166/387, 187
See application file for complete search history.

(56) References Cited

U.S. PATENT DOCUMENTS

| | | | | |
|---|---|---|---|---|
| 3,035,440 | A | 5/1962 | Reed | |
| 3,181,608 | A * | 5/1965 | Palmer | 166/250.02 |
| 3,393,744 | A * | 7/1968 | Fagg et al. | 166/187 |
| 3,899,631 | A * | 8/1975 | Clark | 174/47 |
| 4,353,249 | A | 10/1982 | Lagus et al. | |
| 4,467,865 | A | 8/1984 | Hardymon | |
| 5,184,677 | A * | 2/1993 | Dobscha | 166/187 |
| 5,226,485 | A | 7/1993 | Dobscha et al. | |
| 5,695,008 | A * | 12/1997 | Bertet et al. | 166/187 |
| 6,041,863 | A * | 3/2000 | Lindsey | 166/311 |
| 6,761,222 | B2 * | 7/2004 | Wilson | 166/387 |
| 2006/0289161 | A1 * | 12/2006 | Naquin et al. | 166/285 |

FOREIGN PATENT DOCUMENTS

WO WO2010079237 A1 7/2010

OTHER PUBLICATIONS

International Search Report & Written Opinion dated Apr. 5, 2013 issued in PCT/US2011/061032.

* cited by examiner

*Primary Examiner* — William P Neuder
(74) *Attorney, Agent, or Firm* — Parsons Behle & Latimer

(57) ABSTRACT

Modular hydraulic packer-and-port system and corresponding methods of operation. The system may be installed for temporary, semi-permanent, or permanent deployments. The system and method may provide for hydraulic isolation of target zones in a well while allowing pass-through tubes to the target zones for taking samples, inserting monitoring sensors, and the like.

11 Claims, 5 Drawing Sheets

MODULAR HYDRAULIC PACKER-AND-PORT SYSTEM

CROSS-REFERENCE TO RELATED APPLICATIONS

This application claims priority under 35 USC §119 to U.S. Provisional Patent Ser. No. 61/416,200, filed on Nov. 22, 2010, and titled "MODULAR HYDRAULIC PACKER-AND-PORT SYSTEM," the entire contents of which are hereby incorporated by reference.

STATEMENT REGARDING FEDERALLY SPONSORED RESEARCH OR DEVELOPMENT

The U.S. Government has a paid-up license in this disclosure and the right in limited circumstances to require the patent owner to license others on reasonable terms as provided for by the terms of contracts/grants EAR-0710949 and DMS-0934680, granted by the National Science Foundation.

BACKGROUND

1. Technical Field

The present disclosure relates generally to a system and methods for sampling, monitoring, or influencing isolated zones within wells, shafts, pits, or other boreholes. More particularly, the disclosure relates to hydraulically isolating zones within a well, shaft, pit, or other borehole to monitor or influence the conditions therein.

2. Background

Packer systems already known in the art can be typically used to isolate zones of interest within a well. Typically, a packer is an apparatus deployed within a well that, when activated, forms a contact seal with the inner surface of the well to hydraulically isolate portions of the well. Typical packers can be activated once deployed to a selected location by applying mechanical force down a well string to cause the packer seal assembly to expand and thereby contact the well wall, forming a seal. Other typical packers are activated by adding fluid down the well string, riser column, or dedicated tube to create elevated pressures (i.e., greater than static fluid pressure in the well) within the packer, which triggers the packer seal assembly to inflate or expand until it forms a seal with the well wall.

Such packer assemblies are commonly operated at relatively high pressures within well bores, and so such traditional packer assemblies are used with pressurized wellhead systems, having gas pressure added to the hydraulic head of fluid in the system. Pressurized wellhead systems can be difficult to maintain and may be prone to malfunction (such as pressure leaks), which can increase complexity and expense of well monitoring projects. Further, pressurized wellhead systems can be costly to operate because of the added equipment, materials, operation, and safety aspects of transporting and handling pressurized gas.

Other drawbacks also exist in typical packer systems, such as: limitations on the number of sampling lines that can pass through the interior of the riser for the packer system in its usual configuration; difficulties associated with passing tubes through the interior and past protruding port assemblies; and maintaining pressure-tight seals through manifolds at the surface. Leaks at connections between riser sections commonly occur in systems with O-ring seals due to sand grains lodging in grooves, nicks in the O-rings, or slightly out-of-round deformation in components. Such leaks may be difficult to detect until the system is assembled, at which point the leaks would result in costly time-loss for disassembly to locate and fix.

What is needed, therefore, is a simple and low-cost well zone isolation system that can operate at relatively low wellhead pressures, thus utilizing a non-pressurized wellhead system that provides for measurements to be taken in, samples collected from, and/or fluid(s) pumped into isolated zones within the well.

SUMMARY

Accordingly, the present disclosure describes a modular hydraulic packer-and-port system, and corresponding method of operation, that address the above-noted and other drawbacks of known systems and methods. For example, potential benefits of the present system and method may be a product with relative ease of assembly, maintenance, and disassembly compared to current systems and practices. Benefits may also include, among other things, saved time when performing in-well monitoring and testing. Embodiments disclosed herein may function without supplementary pressurization through a manifold at the wellhead, which may further save time and money because the embodiments disclosed herein may result in (a) initial equipment cost savings, (b) maintenance cost savings, and (c) less down time for assembly, repairs and maintenance compared to systems that employ a pressurized manifold.

Another potential advantage of some embodiments disclosed herein is that tube lines (e.g., tube lines 225) may simply extend along the outside of riser sections (e.g., riser section 210). In contrast, traditional riser systems may utilize a pressure-tight manifold on top of the riser system at the wellhead through which tube lines are threaded, thus increasing system complexity, cost, and set-up difficulty.

Another potential benefit of some disclosed embodiments is the use of simple hydraulic head in an open riser 210 to inflate and maintain inflation of packer sleeves 115. In comparison, traditional systems may involve cumbersome O-ring maintenance (which may include examining, cleaning, or greasing the O-ring and fittings) and wasteful slip-tie security connections at each riser connection in order to reliably function. Other benefits and advantages of the disclosed system and method also exist. For example, the disclosed system may benefit from relative ease of modification of assembly configuration such as adding or removing lengths of riser or packers without removing and disassembling the system due in part to the location of the tubing on the outside of the riser assembly and in part to the number of tubes available to configure for a given isolated zone relative to systems having tubes inside the riser (typical in existing commercial systems).

An additional potential advantage of the disclosed system is that it can be operated (a) in a temporary configuration using water as the fluid to inflate the packers, followed by withdrawing the water and recovering the system for reuse elsewhere, or (b) as a permanent installment by either converting from a water-filled to a grout-filled system, or by using a grout, or other cementitious material, initially to inflate the packers.

The present system and method also has many applications in a variety of fields. For example, many consulting companies providing subsurface hydrology and engineering services for environmental assessment, remediation, monitoring and related development, and mining activities could benefit from use of the present system and method. In addition, geological, hydrological, and other researchers may benefit from use of the disclosed embodiments. Other fields of application are also possible, such as: localized applications for pumping out, pumping in, monitoring, or sampling in mines, pits, tunnels, repositories, or other subsurface regions; other environmental assessment, remediation, monitoring, and related development in the vadose zone or partially saturated region between the land surface and the water table; and monitoring for leakage or contamination associated with energy exploration, development, storage, or under other such circumstances where ground contamination may be suspected.

In one embodiment, there is provided a modular hydraulic packer-and-port system having a tubular riser section and a tubular packer section. The tubular packer section has a longitudinal axis and an internal volume. The tubular packer section further includes a packer pipe, at least one packer collar, a packer sleeve, and at least one tube line. The packer collar is comprised of external flanges on the packer pipe and has at least one pass-through hole parallel to the longitudinal axis of the tubular packer section. The packer sleeve is secured to the packer collar and is manufactured of a flexible, water-impervious material. The packer sleeve has an inner surface in fluid communication with the internal volume of the tubular packer section through a hole in the packer pipe. Each packer collar pass-through hole comprises an external port located external to the packer sleeve and an internal port located within the packer sleeve. The at least one tube line is in fluid communication with a packer collar port.

In another embodiment, there is provided a well isolation and monitoring apparatus having a packer section and at least one tube. The packer section includes a relatively straight packer pipe and a packer sleeve manufactured of flexible, water-impervious material. The packer pipe is adapted to provide fluid communication between an internal volume of the packer pipe and an inner surface of the packer sleeve. The at least one tube is adapted to provide fluid communication between a target isolation zone and a well surface level. At least a portion of the tube is located within the packer sleeve and at least a portion of the tube is located outside the packer sleeve.

One embodiment of a method for isolating and monitoring sections in a well disclosed herein includes deploying at least one packer section into a well, introducing a fluid into a central volume of the packer section at a fluid static pressure greater than the in-well ambient aquifer hydraulic head, and causing at least one packer sleeve to expand and form a seal against an inner surface of the well thereby selectively isolating a section of the well.

The present disclosure will now be described more fully with reference to the accompanying drawings, which are intended to be read in conjunction with both this summary, the detailed description, and any preferred or particular embodiments specifically discussed or otherwise disclosed. This disclosure may, however, be embodied in many different forms and should not be construed as limited to the embodiments set forth herein; rather, these embodiments are provided by way of illustration only so that this disclosure will be thorough, and fully convey the full scope of the disclosure to those skilled in the art.

DETAILED DESCRIPTION

In the following description, reference is made to the accompanying drawings that form a part thereof, and in which is shown by way of illustration specific exemplary embodiments according to the present disclosure which may be practiced. These embodiments are described in sufficient detail to enable those skilled in the art to practice the disclosure, and it is to be understood that modifications to the various disclosed embodiments may be made, and other embodiments may be utilized, without departing from the spirit and scope thereof. The following detailed description is, therefore, not to be taken in a limiting sense.

Figure 1:
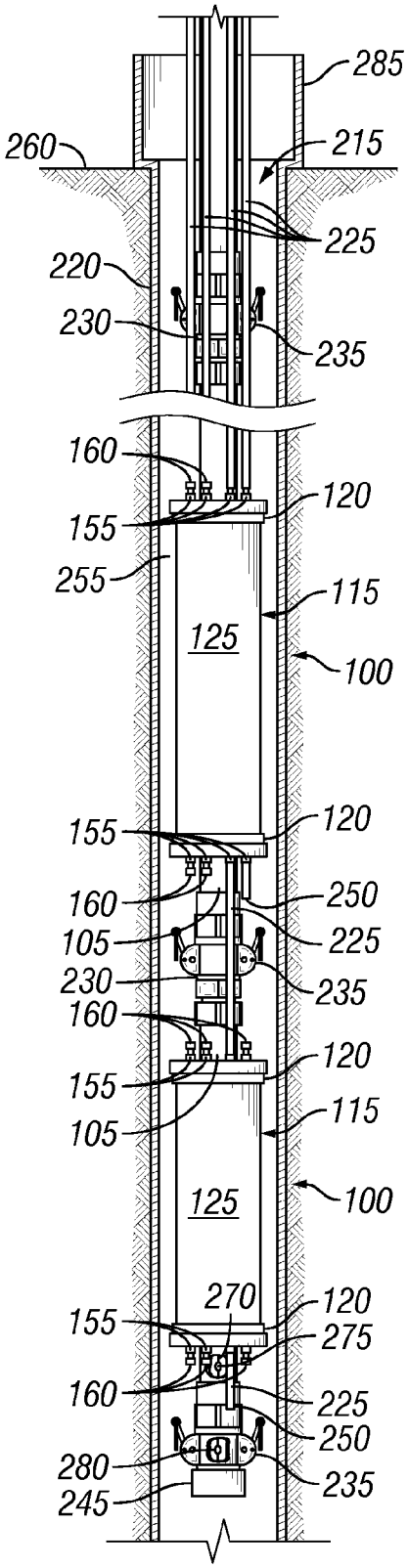
FIG. 1 shows a schematic example of an embodiment of an assembled and deployed modular hydraulic packer-and-port system.

With reference to FIG. 1, the modular hydraulic packer-and-port system and corresponding method may be used to provide targeted sampling, monitoring, pumping, and/or injection in new or existing wells 215 with an easily-assembled and disassembled system that does not require permanent installation or dedicated wells, but which can be installed in a permanent fashion if desired. Such targeted sampling, monitoring, pumping, and/or injection may be employed at contaminated sites, where other engineering management issues could benefit from location-specific information in an aquifer, or at other locations and for other purposes.

In some embodiments, the present system and method may comprise a collection of packer sections 100, spacer sections 205, and a riser section 210. Other types, configurations, or combinations of sections are also possible. As described in detail below, the packer sections 100, spacer sections 205, and riser section 210 may be installed within a well 215 having an unfinished inner well bore wall, well casing 220, or well screen. Other installation environments are also possible.

Figure 2:
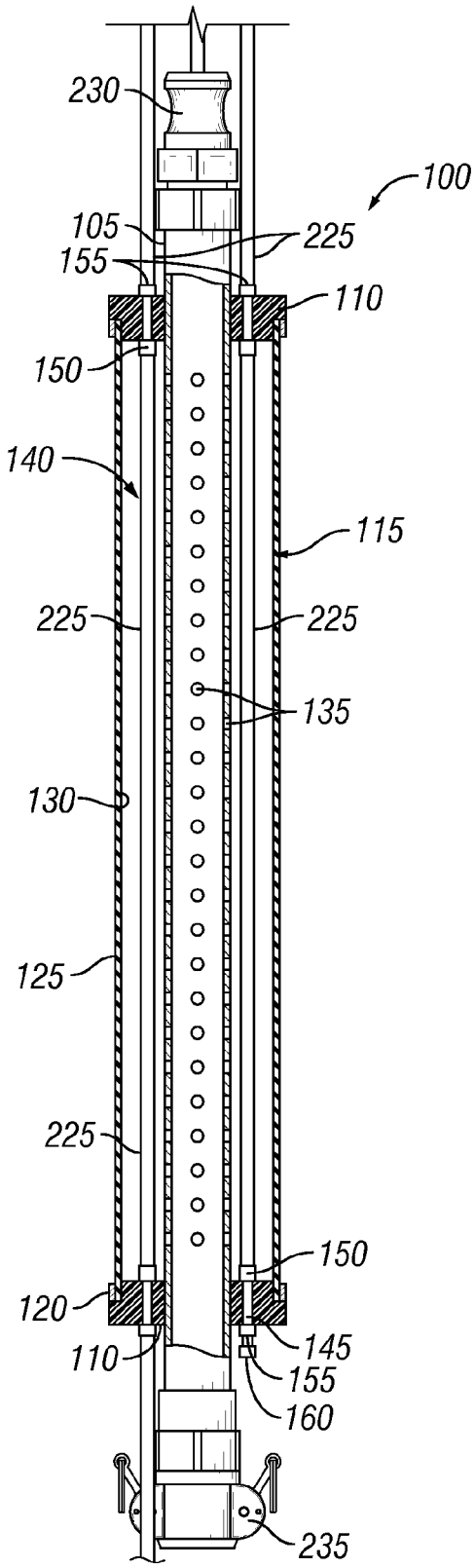
FIG. 2 shows embodiments of a packer, sample tubes, sample tube connectors, and other components.

As shown in FIG. 2, one embodiment of a packer section 100 comprises a relatively straight packer pipe 105, packer collars 110, and packer sleeve 115. Other shapes and configurations for the sections, such as curved, or branched, are also possible. As shown in this embodiment, the packer collars 110 may comprise flanges on the exterior of the packer pipe 105. The packer sleeve 115 may comprise a flexible, water-impervious material having an outer surface 125 and an inner surface 130. The packer sleeve 115 may be secured to packer collars 110 in any suitable fashion, such as with packer sleeve clamps 120. One or more holes 135 through the packer pipe 105 within the packer sleeve 115 provides fluid communication between the inner volume of the packer pipe 105 and the packer sleeve inner surface 130. Other configurations or numbers of holes 135 are also possible. For ease of description, the combined internal volume within packer sleeves 115 between adjacent corresponding packer collars 110 and within the packer pipe 105 may be referred to as the packer inner volume 140.

As also shown for this embodiment, at least one pass-through hole 145 with a longitudinal axis substantially parallel to the longitudinal axis of the packer section 100 may pass through each packer collar 110. Other configurations for the pass-through hole 145 are also possible. Internal collar connectors 150 and corresponding external collar connector 155 may be fitted within opposing sides of each pass-through hole 145 on opposing surfaces of the packer collar 110. The collar connectors 150, 155 may comprise any suitable connector, such as tapered fittings or the like, that may be adapted to securely connect tube lines 225 to connectors 150, 155. As shown in this embodiment, internal collar connectors 150 may be located within the packer sleeve 115 and are, therefore, within the packer inner volume 140. As also shown for this embodiment, external collar connectors 155 may be located outside the packer inner volume 140 and are, therefore, exposed to the well annulus 255 when the packer section 100 is deployed in a well 215. For ease of description, the well annulus 255 may be defined as the volume within the well 215 bordered by the outer surfaces of the sections 100 (including packer sleeve outer surface 125), 205, 210 and by the inner surface of the well casing 220, well screen, or unfinished well bore wall.

Pass-through holes 145 provide fluid communication between each corresponding pair of internal collar connector 150 and external collar connector 155. In the embodiment depicted in FIG. 2, pass-through holes 145 are radially located around each packer collar 110, but other configurations are also possible. As described in more detail below, a higher number of pass-through holes 145 generally allows for, among other things, an increased number of isolated zones 295 that may be monitored from the well surface. Pass-through holes 145 may additionally allow for more than one monitoring, sampling, pumping, and/or injection tube per zone. It will be understood by one of ordinary skill in the art having the benefit of this disclosure that the number of pass-through holes 145 may selectively be customized to fit the particular circumstances of each well monitoring project.

Figure 8:
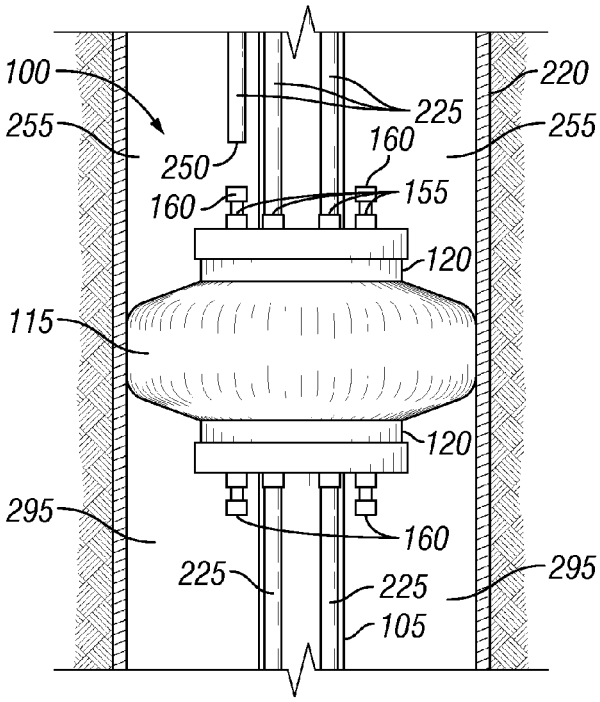
FIG. 8 depicts an embodiment of a packer element deployed within a well.

In the embodiments depicted in FIGS. 1 and 2, the packer sleeves 115 have a length of approximately one meter. Other lengths are possible. A packer section 100 and packer sleeve 115 may have any suitable dimensions. The length of the packer section 100 and packer sleeve 115 may be manufactured to fit industry-accepted standards for well components or may be tailored to fit specific circumstances and local conditions. For illustration, FIG. 8 depicts an embodiment of the present disclosure having a relatively short packer sleeve 115 in comparison to the packer sleeves 115 depicted in FIGS. 1 and 2.

One of ordinary skill in the art having the benefit of this disclosure will be able to determine an optimal packer sleeve 115 length to fit the specific circumstances. Factors that may affect optimal packer sleeve 115 length may include well pressure, the number of target zones to isolate, or borehole configurations.

Figure 3:
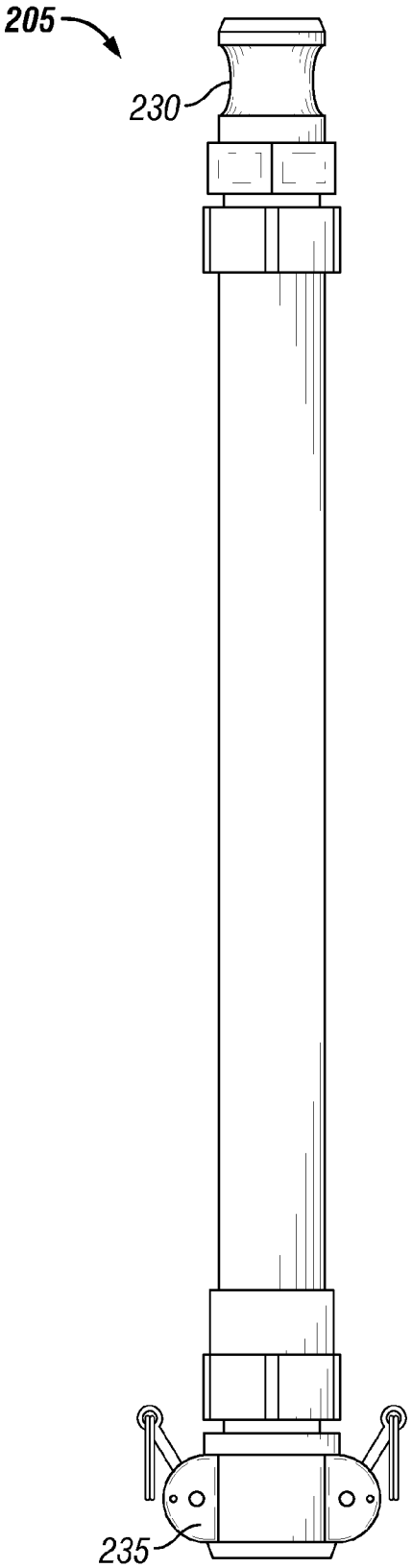
FIG. 3 depicts an embodiment of a spacer section.

As depicted in FIG. 3, a spacer section 205 may comprise a relatively straight cylindrical pipe section. Of course, other shapes and cross-sections are possible in accordance with the intended application. As depicted in FIGS. 2 and 3, packer section 100 and spacer section 205 may comprise one male cam-lock connector 230 (also known in the art as a cam and groove connector) on its upper end and one female cam-lock connector 235 on its lower end. Other configurations and fittings, such as threaded couplers, or the like, to accomplish a pressure-tight inter-locking of the sections are also possible.

Figure 4:
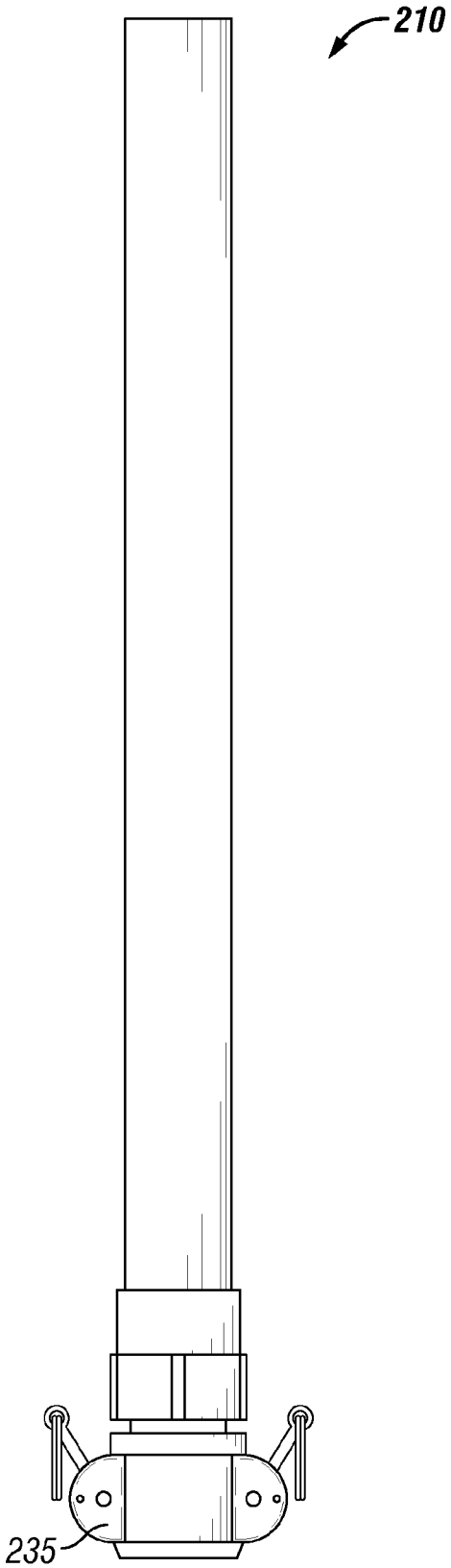
FIG. 4 depicts an embodiment of a riser section.

As shown for the embodiment of FIG. 4, riser section 210 may comprise a female cam-lock connector 235 on its lower end and the other end of riser section 210 may be open to enable access (such as at the top of a well) to the internal volume of the system. As depicted for the embodiments shown in FIGS. 2, 3, and 4, the cam-lock connectors 230, 235 may be fixed to ends of packer section 100, spacer section 205, and riser section 210 and may be adapted to provide secure and pressure-tight connections between the various sections 100, 205, 210 when assembled. Other suitable fittings may also be implemented to secure and seal the various sections.

Figure 5:
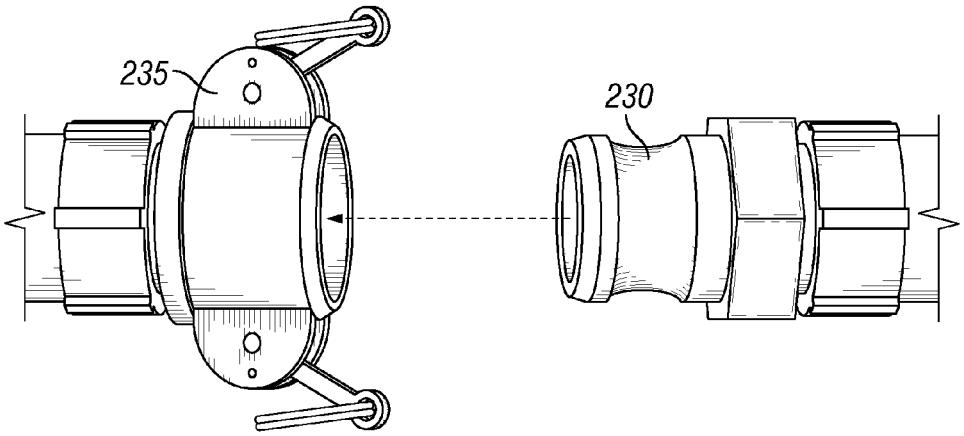
FIG. 5 shows an embodiment of cam-lock connectors.

For the embodiment shown in FIG. 4, the female cam-lock connector 235 of the riser section 210 may be adapted to secure to an upward-facing male cam-lock connector 230 of a packer section 100 or spacer section 205 so that the riser section 210 partially protrudes from the ground surface 260 when the system is installed within a well 215 to facilitate access to and operation of the system. FIG. 5 depicts a male cam-lock connector 230 and female cam-lock connector 235 used in embodiments of the present disclosure. Other types and configurations of connectors may also be used.

Figure 6A:
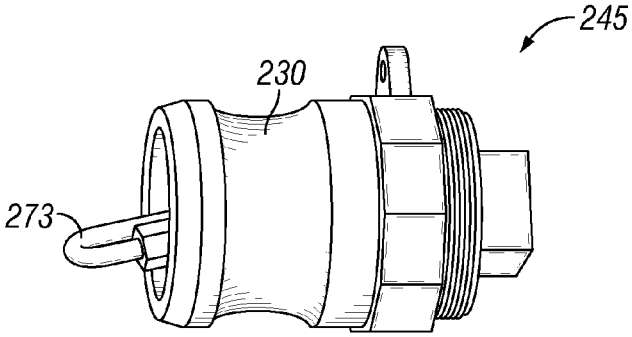
FIG. 6A depicts a base plug secured into a male cam-lock connector.
Figure 6B:
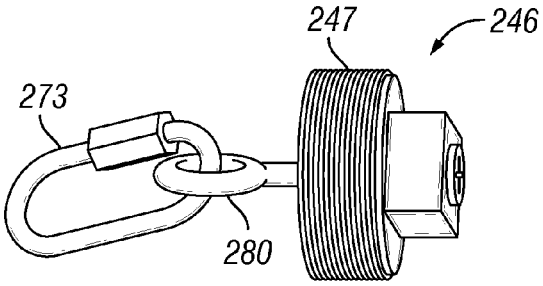
FIG. 6B depicts a threaded base plug.
Figure 6C:
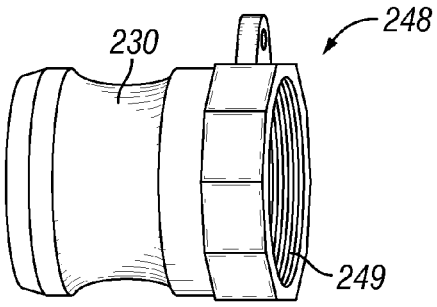
FIG. 6C depicts a cam-lock connector section of a base plug.

As depicted in FIG. 6A, embodiments of the system include a base plug 245 that comprises a male cam-lock connector 230. Base plug 245 may be adapted to provide a secure and pressure-tight connection with an opposing connector, such as a female cam-lock connector 235 of a section 100 205, or 210 at the base of a well 215 (or where otherwise desirable) when the system is installed. Alternatively, the base plug 245 may include a female cam-lock connector 235 adapted to connect with a corresponding male cam-lock connector 230. As depicted in FIG. 6B, certain embodiments of the present disclosure comprise a base plug 246 having connection threads 247 by which the base plug 246 may be directly secured to sections 100, 205, 210, or other sections within a well 215 having corresponding threads. As depicted in FIG. 6C, the base plug 245 may further comprise a cam lock connector section 248 having threads 249 that correspond to threads 247 and that may be adapted to receive the base plug 246. In this manner, the base plug 246 may be converted from a having a threaded connection to a cam-lock connection.

Some embodiments of the system may comprise sections of different dimensions than those disclosed herein to accommodate operation in various sizes of wells. Some embodiments may comprise any number of tube sections. Some embodiments may be combined with a variety of sensors and/or pumps for injecting and/or withdrawing fluid in prescribed combinations at individual zones 295 with different combinations and regimens for different zones. Some embodiments may be combined with automated sensing and activation hardware and software for "smart" monitoring, remediation, and/or other automated tasks.

Returning now to the embodiment shown in FIG. 1, tube lines 225 may be adapted to connect to adjacent corresponding internal collar connectors 150, thereby spanning the volume within a packer sleeve 115. Tube lines 225 may also be provided to additionally connect between external collar connectors 155 on adjacent packer sections 100. Likewise, other tube lines 225 connect to external collar connectors 155 on other packer sections 100. In this manner, a series of connected tube lines 225 may provide fluid communication as desired along a series of sections 100, 205, 210, potentially along all sections 100, 205, 210 within the well 215.

In some embodiments, certain segments of tube lines 225 may further comprise terminal ends 250, which are open to the well annulus 255. A connector cap or plug 160 may be inserted into a collar connector 150 or 155 to selectively seal the corresponding tube line 225 or series of tube lines 225.

Other embodiments disclosed herein may include various additional configurations and components. For example, embodiments of the system and method disclosed herein may include a riser section 210 having a cam-lock connector 230 or 235 at each end so that one cam-lock connector 230 or 235 is exposed above the ground surface 260. For such an embodiment, a cap or well head lock (not depicted) may be adapted to securely lock to the exposed upper end of the riser section 210, thereby mitigating unauthorized access to, tampering with, or removal of the system when installed.

As depicted in FIG. 1, certain embodiments of the present disclosure may comprise security apparatus, such as cable segments 270. The cable segments 270 may be adapted to secure the system to a well head lock. This may be accomplished in any suitable fashion, such as by allowing the cable segments 270 to pass through the inner volume of sections 100, 205, 210, link to other security cable segments 270 with threaded connectors 273 (depicted in FIGS. 6A and 6B), and secure to the base plug 245 or 246 via threaded connectors 273 and base plug loop 280. Other configurations are also possible. In this manner, links of the security cable 270 are adapted to securely hold the well head lock in place when the system is not being used. In embodiments of the present disclosure, the well head lock includes a notch or pass-through hole through which a cable segment 270 may pass for securing the well head lock to the riser section 210. Cable segments 270, cable loops 275, and other security components may be made from steel aircraft cable or other strong cable that provides for well security as explained herein. A well protective outer casing 285 may be installed above ground 260 to further protect the riser section 210 from tampering or damage.

Some embodiments of the present disclosure may also include suitable anchoring mechanisms, such as anchor collars (not shown) for anchoring packer or spacer sections 100, 205 to the well casing 220, well screen, or unfinished well bore wall. Such anchoring mechanisms may be activated by increasing the fluid pressure within the internal volume of the sections 100, 205, by mechanically activating the anchor collars, or by other means known in the art.

As will be understood by one of ordinary skill in the art having the benefit of this disclosure, the packer pipe 105, spacer section 205, and riser section 210 may be manufactured from materials demonstrating suitability to be adapted to conditions expected to be encountered within the well 215. A suitability determination of the materials of manufacture for the various components deployed in the system may include consideration of the weight of the materials for portability, the strength of the materials for durability, and other factors such as chemical compatibility with ambient or treated water chemistry, well materials, or other conditions. For example, in embodiments of the system disclosed herein, the sections 100, 205, 210, and packer collars 110 may be made from PVC and the packer sleeve 115 disclosed herein may be made from an elastomeric material soft and flexible enough to expand to form a contact seal with the well bore surface 220 as described below. Other elements disclosed herein, such as packer sleeve clamps 120, cam lock connectors 230, 235, well head lock, and base plug 245, 246, or 248 may be manufactured from stainless steel, some other oxidation-resistant structural material, or any other suitable material. Some elements of disclosed embodiments, such as collar connectors 150, 155, and connector cap 160, may be made of plastic or other synthetic polymer materials. One of ordinary skill in the art having the benefit of this disclosure will understand that other suitable materials may be substituted to suit the ambient conditions, such as fluid pressure and composition, deployment location, and other factors.

The sections 100, 205, and 210 may have various tubing and connector diameters. As will be understood by one of ordinary skill in the art having the benefit of this disclosure, component diameters and cross-sections may be customized to fit the environmental factors of the well 215. For example, greater-diameter tube lines 225 may be utilized to reduce pressure loss along the lengths of tube lines 225 or to accommodate sensors of different dimensions. Factors that may be taken into account to determine the respective diameters of tubing 225, connectors 150, 155, and caps 160 may include depth of the well 215, water head, the composition of liquids in the well 215, diameter of the well 215, and other considerations.

In addition, optimal diameter, size, thickness, and elasticity of the packer sleeves 115 may be determined from a number of factors. One of ordinary skill in the art having the benefit of this disclosure will be able to determine, without undue experimentation, optimal specifications of the packer sleeves 115 (e.g., the non-expanded diameter, material(s), length between sleeves 115, etc.) in order to provide sufficiently secure seals.

The following exemplary descriptions of methods of operation are disclosed in accordance with some embodiments of the present disclosure. In the operation of some embodiments, a base plug 245 or 246 may be securely connected to a segment of packer section 100 or spacer section 205 with the cam-lock connectors 230, 235 before lowering the connected segments down into a well 215. If a security cable 270 is to be utilized with the installation, it may be secured to the base plug loop 280 via threaded connector 273 prior to connecting the base plug 245 to segment 100 or 205, and then linked to other security cables 270 (also via threaded connector 273) threaded through the inner volumes of sections 100, 205, 210 that may be deployed within the well 215.

Next, packer sections 100 may be connected to other segments 100, 205 in such order as to selectively place the packer sections 100 at or near desired monitoring depths within the well 215. As the segments 100, 205 are assembled, tube lines 225 may be selectively connected to opposing internal collar connectors 150 and to corresponding external collar connectors 155. Tube line terminal ends 250 may be selectively placed at or near desired monitoring depths within the well 215. Segments of tube lines 225 may thus be connected to series of internal and external collar connectors in such a manner that communication along the entire string, or any desired portion of connected sections 100, 205, or 210, may be provided through connected tube lines 225. A tube line terminal end 250 may be placed for each desired monitoring depth and similarly connected to a series of tube line 225 along sections 100, 205, 210.

Generally, a portion 295 of a well 215 may be hydraulically isolated from other portions of the well by selectively straddling that portion 295 with packer sections 100 and then inflating the packer sleeves 115 as described below. By placing a tube line terminal end 250 within that zone 295 and connecting the tube lines 225 along adjacent segments 100, 205, 210 as described above, the tube lines 225 may provide fluid communication from above the ground 260 to the isolated portion 295 of the well 215. In this manner, tube lines 225 may provide access to fluid-filled portions of the tubing 225 and hence the zones 295.

After connecting and deploying the series of packer sections 100 and spacer sections 205 into the well 215, a riser section 210 may be connected to the uppermost segment 100 or 205, following which the connected series of sections 100, 205, 210 may be fully deployed within the well 215 so that only a top portion of the riser section 210 remains above the surface of the ground 260—whereupon the packer sections 100 may be located within the well 215 to straddle each zone 295 to be monitored, with a tube line terminal end 250 being located within each zone 295 and in fluid communication with the surface 260, or an instrument passed from the surface 260 down the tubes 225 toward the zone 295, through series of tube lines 225 and collar connectors 150, 155.

As one of ordinary skill in the art having the benefit of this disclosure would understand, components disclosed herein may be installed and deployed using tools already known in the art. For example, one may use a Kwik Klamp, manufactured by J&K Tool Company, Inc. of Wheaton, Minn. as a handling tool to connect and deploy sections 100, 205, and 210 within a well 215.

Upon placement of the packer sections 100 to straddle the well zones 295, the packer sleeves 115 may be expanded by pouring, pumping, or otherwise introducing water or other fluid into the central bore of section 210 until the fluid level within the sections 100, 205, 210 is higher than the level of well fluid in the well annulus 255. Once the level within the sections 100, 205, 210 is higher than the water within the annulus 255, the inner surface of the packer sleeve 130 may undergo increased pressure in relation to the pressure at the outer surface of the packer sleeve 125. Because the packer sleeves 115 are manufactured from flexible and elastic material, the increased internal pressure may radially expand the packer sleeve 115 until it comes into contact with the inner surfaces of the well 220, thereby forming contact seals and hydraulically isolating the zones 295 from the other portions of the well annulus 255. FIG. 8 depicts a packer 100 deployed in a well 215. The packer sleeve 115 depicted is expanded to form a contact seal with surface 220, thereby hydraulically isolating zone 295 from other portions of the well annulus 255.

Alternatively, in permanent or semi-permanent well deployments, the packer sleeves 115 may be inflated by introducing grout, cement, or the like into the central bore of riser section 210, thereby filling packer inner volumes 140 and causing the packer sleeves 115 to expand and contact the inner surfaces of the well 220 and form contact seals. Such operation may ensure that upon hardening of the grout, cement, or the like, zones 295 are hydraulically isolated permanently or semi-permanently.

As described above, tube lines 225 may provide fluid communication from the ground surface 260 to the isolated zone 295, which may allow for measurements such as monitoring well fluids for pressure, temperature, and/or other parameters in the isolated zones 295. Measurements or samples can be taken through the tube lines 225 connecting the isolated zone (s) 295 to the surface 260. For example, samples may be pumped to the surface 260 through the tube lines 225, or direct measurements may be taken with narrow-gauge sensors 300 (e.g., fiber optic or other transducers) inserted down the tube line(s) 225 to reach the isolated zones 295.

In some embodiments, the packer sleeve 115 may be expanded with hydraulic pressure that is greater than static pressure in the borehole annulus 255. The excess hydraulic pressure may be generated by simply pouring water into the riser section 210 to a particular level above the static fluid level in the well annulus 255. The static fluid level in the well annulus 255 may be determined by a simple measurement taken before deploying the sections 100, 205, 210 into the well 215. For example, the static fluid level may be measured using an electric tape or the like. The amount of excess head for inflating the packers may then be determined from appropriate tables or other reference materials familiar to one of ordinary skill in the art.

In some embodiments, the sections 100, 205, or 210 may be removed from the well 215 by pumping or otherwise removing the water or other fluid from the sections 100, 205, and 210 until the packer sleeve(s) 115 deflate, at which point the sections 100, 205, and 210 can be removed. Embodiments of the system and method may also include implementing a water removal pump or other associated equipment advantageous to assemble and disassemble the system in a given well 215.

Figure 7:
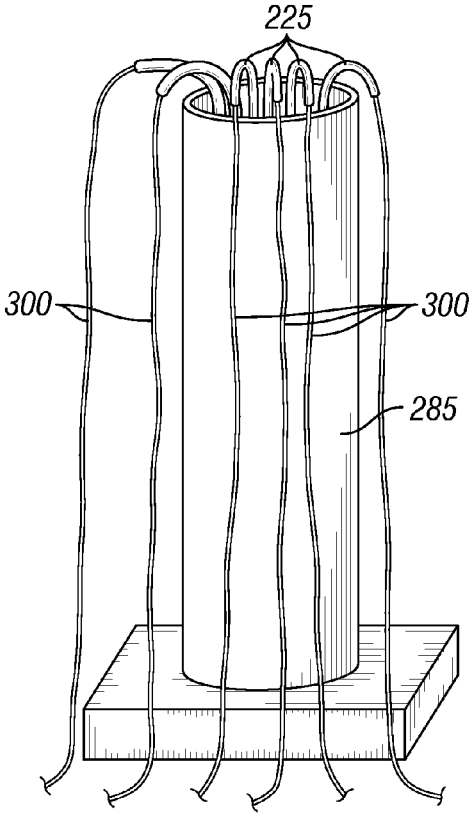
FIG. 7 depicts an embodiment of the disclosed system in use at a wellhead having tubes and measurement cables protruding therefrom.

Embodiments of the system and method disclosed herein have been tested in wells at a research site. FIG. 7 depicts tube lines 225 extending from protective outer casing 285. As shown in FIG. 7, the system of the present disclosure provides a simple, easy-access configuration for linking measurement devices to isolated zones 295 in the well 215. For example, fiber optic transducers 300 or other similar small diameter sensors are inserted into the tube lines 225 and pass through the tube lines 225 to the isolated zone 295 for measurements on the fluids there.

In the operation of the disclosed system and method, measurement device cables 300 may be installed and removed relatively quickly to allow security protection of the well 215 between uses (e.g., overnight, or over longer periods of inactivity as desired). Measurement devices may be linked to data logging and field computer hardware/software. Collection of well fluid samples may be accomplished by connecting some or all of the tube lines 225 to a sampling pump (e.g., multi-cartridge peristaltic pump) that may be located at the ground surface 260 near the well 215.

Figure 9:
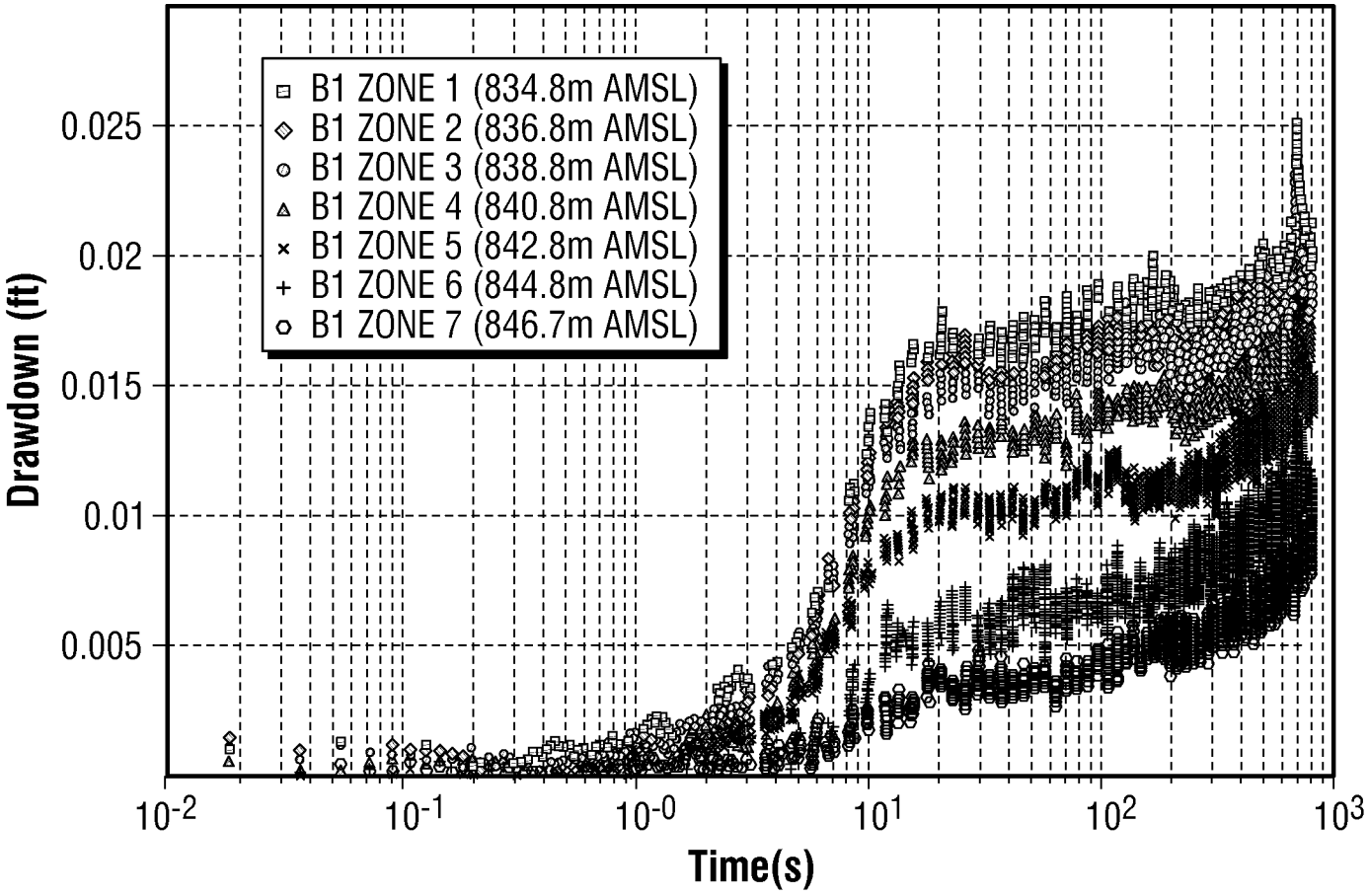
FIG. 9 shows the pressure-change responses in seven isolated zones in a well using some embodiments of the system and method during a controlled pumping test.

FIG. 9 shows the pressure-change responses in seven isolated zones 295 in a well 215 using embodiments of the system and method described herein during a controlled pumping test. As shown in FIG. 9, data may be collected using some embodiments of the system providing access to seven isolated zones 295 (labeled B1 Zone 1 through B1 Zone 7). The seven isolated zones 295 provide systematically different responses to pumping from a zone in another well. FIG. 9 demonstrates that at least partial hydraulic isolation may be achieved using the present system and method because all seven pressure sensors would likely give similar open-well averaged responses if the system had not provided at least partial local pressure isolation for each zone 295 in the well 215.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the spirit and scope of the present disclosure.

What is claimed is:

1. A modular hydraulic packer-and-port system comprising:

a tubular riser section;

a tubular spacer section;

a tubular packer section having a longitudinal axis and an internal volume, the tubular packer section further comprising:

a packer pipe;

an upper packer collar comprising an external flange on the packer pipe, the upper packer collar having a plurality of pass-through holes parallel to the longitudinal axis of the tubular packer section;

a lower packer collar comprising an external flange on the packer pipe, the lower packer collar having a plurality of pass-through holes parallel to the longitudinal axis of the tubular packer section;

a packer sleeve secured to the upper packer collar and the lower packer collar, the packer sleeve comprising a flexible, water-impervious material, wherein the packer sleeve has an inner surface in fluid communication with the internal volume of the tubular packer section through a hole in the packer pipe through which the packer sleeve may be inflated or deflated by the flow of fluid therethrough;

wherein each packer collar pass-through hole comprises an external collar connector located external to the packer sleeve and an internal collar connector located within the packer sleeve; and at least one tube line configured to be connectable between any of the plurality internal collar connectors of the upper packer collar and any of the plurality of internal collar connectors of the lower packer collar.

2. The modular hydraulic packer-and-port system of claim 1, wherein the spacer section and the packer section has a first end and a second end, wherein each first end comprises a male cam-lock connector and each second end comprises a female cam-lock connector adapted to receive a male cam-lock connector of another spacer section or packer section.

3. The modular hydraulic packer-and-port system of claim 1, wherein the packer sleeve is secured to the upper and lower packer collars with clamps.

4. The modular hydraulic packer-and-port system of claim 1, wherein the at least one tube line is adapted to provide fluid communication between the external collar connector of the upper packer collar and the external collar connector of the lower packer collar.

5. A well isolation and monitoring apparatus, comprising:

a packer section having a relatively straight packer pipe and a packer sleeve manufactured of flexible, water-impervious material, wherein the packer pipe is adapted to provide fluid communication between an internal volume of the packer pipe and an inner surface of the packer sleeve in order to inflate or deflate the packer sleeve;

an upper packer collar comprising an external flange on the packer pipe, the upper packer collar having a plurality of pass-through holes parallel to the longitudinal axis of the packer section;

a lower packer collar comprising an external flange on the packer pipe, the lower packer collar having a plurality of pass-through holes parallel to the longitudinal axis of the packer section;

wherein each packer collar pass-through hole comprises an external collar connector located external to the packer sleeve and an internal collar connector located within the packer sleeve;

a first tube, connected to an internal collar connector of the upper packer collar and an internal collar connector of the lower packer collar;

a second tube connected to an external collar connector of the lower packer collar and further adapted to provide fluid communication between a target isolation zone and a well surface level, wherein the first tube is located within the packer sleeve and the second tube is located outside the packer sleeve.

6. The well isolation and monitoring apparatus of claim 5, wherein the packer sleeve is secured to the upper and lower packer collars with clamps.

7. The well isolation and monitoring apparatus of claim 5, wherein the internal and external collar connectors are adapted to secure to the at least one tube first and second tubes.

8. A method of isolating and monitoring sections in a well, comprising:

deploying at least one packer section into a well, the well having an in-well ambient aquifer hydraulic head, and the at least one packer section further comprising:

an upper packer collar comprising an external flange on the packer pipe, the upper packer collar having a plurality of pass-through holes parallel to the longitudinal axis of the tubular packer section;

a lower packer collar comprising an external flange on the packer pipe, the lower packer collar having a plurality of pass-through holes parallel to the longitudinal axis of the tubular packer section;

a packer sleeve secured to the upper packer collar and the lower packer collar, the packer sleeve comprising a flexible, water-impervious material, wherein the packer sleeve has an inner surface in fluid communication with the internal volume of the tubular packer section through a hole in the packer pipe through which the packer sleeve may be inflated or deflated by the flow of fluid therethrough;

wherein each packer collar pass-through hole comprises an external collar connector located external to the packer sleeve and an internal collar connector located within the packer sleeve; and at least one tube line configured to be connectable between any of the plurality internal collar connectors of the upper packer collar and any of the plurality of internal collar connectors of the lower packer collar; the method further comprising:

introducing a fluid or slurry into a central volume of the at least one packer section at a fluid static pressure greater than the in-well ambient aquifer hydraulic head;

causing the packer sleeve to inflate and form a seal against an inner surface of the well thereby selectively isolating a section of the well.

9. The method of claim 8, further comprising inserting at least one measuring device into at least one of the at least one tube line to selectively monitor, sample from, or inject fluid into isolated sections in the well.

10. The method of claim 8, wherein introducing a fluid or slurry into a central volume of the at least one packer section comprises pouring water into a riser section installed in the well.

11. The method of claim 8, wherein introducing a fluid or slurry into a central volume of the at least one packer section comprises pouring grout or cement into a riser section installed in the well.

* * * * *

UNITED STATES PATENT AND TRADEMARK OFFICE

CERTIFICATE OF CORRECTION

PATENT NO. : 8,770,305 B2
APPLICATION NO. : 13/232876
DATED : July 8, 2014
INVENTOR(S) : Warren Barrish and Michael Cardiff It is certified that error appears in the above-identified patent and that said Letters Patent is hereby corrected as shown below:

In the Claims

Col. 12, Line 8-11, Claim 7, should read

--7. The well isolation and monitoring apparatus of claim 5, wherein the internal and external collar connectors are adapted to secure to the first and second tubes.--

Signed and Sealed this
Tenth Day of March, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,770,305 B2
APPLICATION NO. : 13/232876
DATED : July 8, 2014
INVENTOR(S) : Barrash et al.

It is certified that error appears in the above-identified patent and that said Letters Patent is hereby corrected as shown below:

In the specification

STATEMENT REGARDING FEDERALLY SPONSORED RESEARCH OR DEVELOPMENT

Column 1, lines 15-21 insert,

--[0002] This invention was made with government support under Contract No. W911NF-09-01-0534 awarded by the Army Research Office. The government has certain rights in the invention. In addition the government has a paid-up license in this disclosure and the right in limited circumstances to require the patent owner to license others on reasonable terms as provided for by the terms of contracts/grants EAR-0710949 and DMS-0934680, granted by the National Science Foundation.--

Signed and Sealed this
Twenty-ninth Day of December, 2015

Michelle K. Lee

Michelle K. Lee
*Director of the United States Patent and Trademark Office*